United States Patent [19]

Philibert

[11] Patent Number: 4,474,316

[45] Date of Patent: Oct. 2, 1984

[54] TIE HANGER

[76] Inventor: Claude L. Philibert, 13085 Chef Menteur Hwy., New Orleans, La. 70127

[21] Appl. No.: 417,200

[22] Filed: Sep. 13, 1982

[51] Int. Cl.[3] ..... A47J 51/24; A47J 51/084

[52] U.S. Cl. ..... 223/88; D6/315; 211/113; 211/123; 223/DIG. 1; 223/85

[58] Field of Search ..... 211/113, 123, 124, 105.1, 211/13; 223/DIG. 1, 85, 87, 88; D6/251

[56] References Cited

U.S. PATENT DOCUMENTS

| | | | |
|---|---|---|---|
| 806,805 | 12/1905 | Hardin | 211/113 X |
| 1,760,339 | 5/1930 | Bishop | D6/251 UX |
| 2,252,916 | 8/1941 | Crosby | 211/123 X |
| 2,403,834 | 7/1946 | Streit | 223/87 |
| 2,510,452 | 6/1950 | Witt | 211/124 X |
| 2,546,720 | 3/1951 | Brothers | 211/123 X |
| 2,643,775 | 6/1953 | Franklin | 211/123 X |
| 2,658,626 | 11/1953 | Arsencault | 211/124 X |
| 3,592,343 | 7/1971 | Swett et al. | 211/113 X |

FOREIGN PATENT DOCUMENTS

| | | | |
|---|---|---|---|
| 2551090 | 5/1977 | Fed. Rep. of Germany | 211/113 |
| 1271711 | 8/1961 | France | 223/85 |
| 508219 | 1/1955 | Italy | 211/113 |
| 310204 | 12/1955 | Switzerland | 211/113 |

*Primary Examiner*—Robert Mackey

*Attorney, Agent, or Firm*—Arthur L. Lessler

[57] ABSTRACT

A tie hanger comprising a closet hanger having a lower horizontal bar with a non-circular cross-section, and a plurality of hanger cards having holes conforming to the non-circular cross-section of the bar, the cards being mounted on the bar via said holes for sliding movement thereon. Each card is symmetrical about a vertical plane passing through the support hole, and has parallel pairs of wings with slots between them for supporting ties. The lower wings are wider than the upper wings to facilitate insertion and removal of ties, and the hanger bar has an I-shaped cross-section and an openable end. A pair of protuberances extends into the support hole to frictionally engage the sides of the hanger bar, so as to prevent the card from sliding along the bar and bunching up with other cards.

3 Claims, 4 Drawing Figures

TIE HANGER

BACKGROUND OF THE INVENTION

This invention relates to a tie hanger which is particularly suitable for use as (but not limited to) a hanger for hanging on a closet rod and holding ties.

Various types of tie hangers are known in the art. A first type of tie hanger employs a unitary structure for supporting the hanger and for holding a fixed number of ties. Arrangements of this type are shown in U.S. Pat. Nos. Des. 175,456; Des. 165,886; 2,401,835; 2,492,226; and 2,605,000.

A second type of tie hanger utilizes a plurality of insertable/removable "cards" to hold individual ties, with the cards being hung on a supporting bar. The present invention relates to arrangements of the second type. Such arrangements are shown, for example, in U.S. Pat. Nos. Des. 208,890; 2,403,834; and 3,790,045. Another arrangement of this second type is shown in an advertisement in the June 2, 1982 edition of The Wall Street Journal, page 31.

Generally speaking, while tie hangers of said second type have the advantage that the number of ties to be accommodated can be increased by installing more cards on the supporting bar, the overall structure is difficult to handle because ties tend to swing wildly when the support hanger is removed from a closet rod, and to slide along the hanger and bunch up at one end thereof. Further, mounting and removal of ties often requires bending of the cards, which are subject to breakage as a result of repeated bending.

Accordingly, an object of the present invention is to provide a tie hanger which overcomes the aforementioned disadvantages of prior art arrangements.

SUMMARY OF THE INVENTION

As herein described, there is provided a tie hanger, comprising: a hanger comprising support means and a horizontal tie-supporting bar of non-circular cross-section having an open or openable end; and at least one tie-supporting card symmetrical about a vertical plane thereof and having: an upper hole of non-circular cross-section lying in said vertical plane for receiving said tie-supporting bar; a pair of lower wings extending transversely from opposite sides of said vertical plane; a pair of upper wings extending transversely from opposite sides of said vertical plane above said lower wings and below said upper hole; said upper wings being disposed in juxtaposition with said lower wings, so that the upper surfaces of said lower wings and the lower surfaces of said upper wings cooperate to define a pair of slots for receiving corresponding ties.

Also herein described is a tie-supporting card disposed about a vertical plane thereof and having: an upper hole of non-circular cross-section lying in said vertical plane for receiving a tie-supporting bar; a pair of lower wings extending transversely from opposite sides of said vertical plane; a pair of upper wings extending transversely from opposite sides of said vertical plane above said lower wings and below said upper hole; said upper wings being disposed in juxtaposition with said lower wings, so that the upper surfaces of said lower wings and the lower surfaces of said upper wings cooperate to define a pair of slots for receiving corresponding ties.

IN THE DRAWING

FIG. 1 is a perspective view showing a tie hanger according to a preferred embodiment of my invention;

FIG. 2*a* is a front elevation view of the card utilized in the hanger of FIG. 1;

FIG. 2*b* is a side cross-sectional elevation view of said card; and

FIG. 2*c* is a front cross-sectional elevation view thereof.

DETAILED DESCRIPTION

Figure 1:
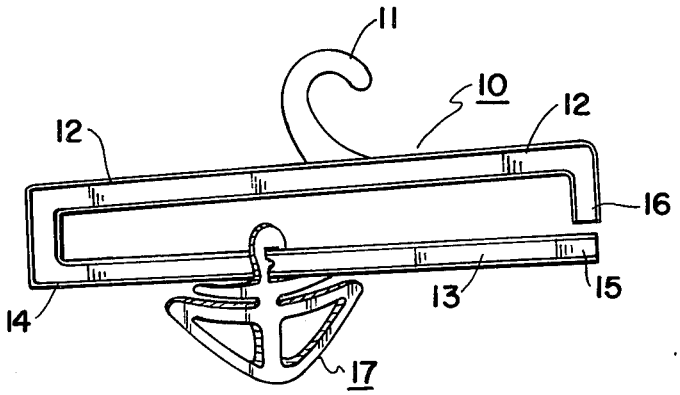

As seen in FIG. 1, the hanger 10 has an upper supporting hook 11 for hanging on a closet rod or the like, and a support portion 12 extending downwardly at the ends thereof to support the horizontal bar 13. The bar 13 is integral with the support portion 12 at the end 14 thereof, and has an end 15 which is detachably connected to the support portion 12 at the end 16 thereof.

The hanger 10 is preferably made of a semi-rigid plastic material or of wood, sufficiently rigid so that the bar 13 does not bend; and sufficiently flexible so that the ends 15 and 16 may be moved horizontally apart to permit insertion and removal of the tie-supporting card 17, without breakage of the hanger at 14.

The means for detachably securing the bar end 15 to the support portion end 16 preferably is a snap-fit due to closely matched complementary surface configurations thereof. However, a screw or any other conventional securing mechanism may be employed. The means by which the ends 15 and 16 are interconnected does not constitute a part of the present invention.

Figure 2A:
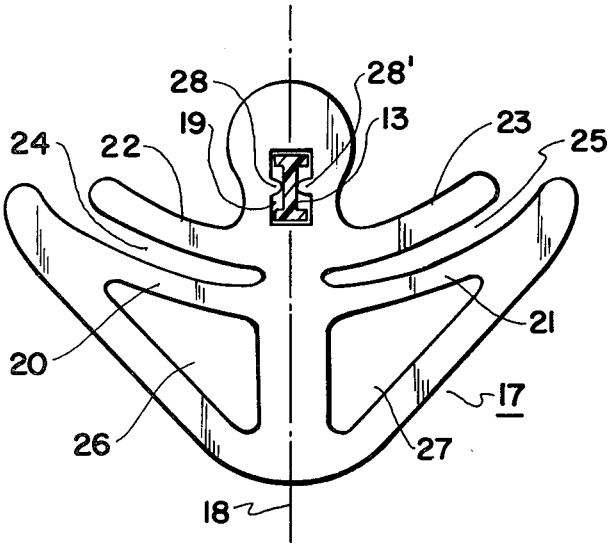
Figure 2B:
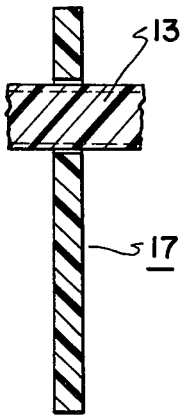
Figure 2C:
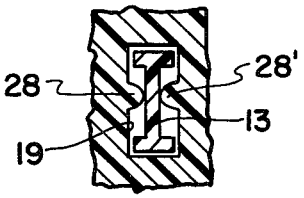

As best seen in FIGS. 2*a* and 2*c*, the support bar 13 has an I-shaped cross-section; and the card 17 is symmetrical about its central vertical plane 18 and has a vertically elongated rectangular upper hole 19 for receiving the bar 13. Alternatively, the support bar 13 may have a vertically elongated rectangular cross-section.

A pair of protuberances 28 and 28' extend inwardly from the vertical sides of the upper hole 19 to frictionally engage the sides of the support bar 13, so that the card 17 does not slide along the support bar 13 to bunch up with similar cards mounted on said bar, at one end of the bar, causing undesirable tilting of the bar. The protuberances 28 and 28' are disposed opposite each other, and extend along the direction of the support bar 13 a sufficient distance so that there is no twisting of the card 17, i.e. so that the card 17 remains perpendicular to the support bar 13. The frictional force between the protuberances 28 and 28' and the support bar 13 is sufficiently great to prevent accidental sliding along the bar, while being sufficiently small to enable the card 17 to be manually slid along the bar to a desired position.

The non-circular cross-section of the bar 13 and the corresponding non-circular cross-section of the upper hole 19 prevents rotation of the card 17 with respect to the bar 13, thus keeping any ties mounted on the card 17 from swinging when the hanger 10 is moved about; and preventing rotation of the card 17 due to weight imbalance when only one tie is mounted thereon.

The I-shaped cross-section of the bar 13 minimizes the area of contact with the upper hole 19 of the card 17, so that sliding friction is kept to a minimum, thus facilitating sliding insertion of cards on the bar 13 and sliding removal of cards therefrom.

Extending transversely from the central plane 18 of the card 17 are a pair of arcuate upwardly directed wings 20 and 21, for supporting corresponding ties. A somewhat narrower pair of arcuate upwardly directed upper wings 22 and 23 is disposed in juxtaposition with the lower wings 20 and 21 respectively, the upper wings 22 and 23 being disposed above the lower wings 20 and 21 and below the upper hole 19.

The arcuate shape of the wings, and the lateral extension of the lower wings beyond the upper wings, makes it relatively easy to insert ties into, and remove ties from the slots 24 and 25 formed between them.

The weight of the card 17 is reduced by providing holes 26 and 27 below the lower wings 20 and 21, to reduce the manufacturing cost (since less material is required) and create an anchor effect.

The card 17 is preferably made of a rigid or semi-rigid plastic, wood, or other suitable material, and of sufficient thickness so that the wings 20–23 resist deflection.

If desired, the bar 13 can be provided as a wall-mounted structure instead of part of a closet hanger.

I claim:

1. A tie hanger, comprising:

a hanger comprising support means and a horizontal tie-supporting bar of generally I-shaped cross-section having an openable end, said tie-supportiing bar having:

a vertically oriented relatively narrow major central portion, a relatively wide upper portion of generally rectangular cross-section having parallel vertically extending edges and a substantially flat laterally extending upper surface for slidably supporting the weight of a tie-supporting card and any ties mounted on said card, and a relatively wide lower portion of generally rectangular cross-section having parallel vertically extending edges and a substantially flat laterally extending lower surface for slidably guiding a tie-supporting card, the vertical extent of each of said vertically extending edges of said upper and lower portions of said tie-supporting bar being substantially less than the vertical extent of said major central portion thereof, said major central portion cooperating with said upper and lower portions to define a leftwardly opening generally U-shaped recess and a rightwardly opening generally U-shaped recess; and at least one tie-supporting card symmetrical about a vertical plane thereof and having:

an upper hole of generally rectangular cross-section lying in said vertical plane for receiving said tie-supporting bar, said hole having (i) upper and lower horizontally extending walls and (ii) left and right vertically extending walls, and being dimensioned to closely surround the upper and lower portions of said tie-supporting bar, said upper horizontally extending wall of said hole being supported by said laterally extending upper surface of said tie-supporting bar, said lower horizontally extending wall of said hole being maintained in position by said laterally extending lower surface of said tie-supporting bar;

a pair of upwardly directed arcuate lower wings extending transversely and symmetrically from opposite sides of said vertical plane;

a pair of upper wings extending transversely and symmetrically from opposite sides of said vertical plane above said lower wings and below said upper hole;

said upper wings being less wide than said lower wings and disposed in juxtaposition therewith, so that the upper surfaces of said lower wings and the lower surfaces of said upper wings cooperate to define a pair of upwardly directed arcuate slots symmetrically disposed about said vertical plane for receiving corresponding ties;

a first protuberance extending into said left U-shaped recess from said left vertically extending wall of said hole to be adjacent said major central portion of said tie-supporting bar at a point intermediate said upper and lower portions thereof; and a second protuberance extending into said right U-shaped recess from said right vertically extending wall of said hole to be adjacent said major central portion of said tie-supporting bar at a point intermediate said upper and lower portions thereof, said second protuberance being disposed opposite said first protuberance.

2. The tie hanger according to claim 1, wherein said protuberances engage said major portion of said tie-supporting bar with a frictional force sufficiently great to prevent accidental sliding of said card along said bar, said frictional force being sufficiently small to enable the card to be manually slid along the bar to a desired position.

3. A tie hanger, comprising:

A hanger comprising support means and a horizontal tie-supporting bar of generally I-shaped cross-section having an openable end, said tie-supporting bar having:

a vertically oriented relatively narrow major central portion, a relatively wide upper portion of generally rectangular cross-section having parallel vertically extending edges and a substantially flat laterally extending upper surface for slidably supporting the weight of a tie-supporting card and any ties mounted on said card, and a relatively wide lower portion of generally rectangular cross-section having parallel vertically extending edges and a substantially flat laterally extending lower surface for slidably guiding a tie-supporting card, the vertical extent of each of said vertically extending edges of said upper and lower portions of said tie-supporting bar being substantially less than the vertical extent of said major central portion thereof, said major central portion cooperating with said upper and lower portions to define a leftwardly opening generally U-shaped recess and a rightwardly opening generally U-shaped recess; and at least one tie-supporting card symmetrical about a vertical plane thereof and having:

an upper hole of generally rectangular cross-section lying in said vertical plane for receiving said tie-supporting bar, said hole having (i) upper and lower horizontally extending walls and (ii) left and right vertically extending walls, and being dimensioned to closely surround the upper and lower portions of said tie-supporting bar, said upper horizontally extending wall of said hole being supported by said laterally extending upper surface of said tie-supporting bar, said lower horizontally extending wall of said hole being maintained in position by said laterally extending lower surface of said tie-supporting bar;

a pair of tie-supporting wings extending transversely and symmetrically from opposite sides of said vertical plane below said hole;

a first protuberance extending into said left U-shaped recess from said left vertically extending wall of said hole to be adjacent said major central portion of said tie-supporting bar at a point intermediate said upper and lower portions thereof; and a second protuberance extending into said right U-shaped recess from said right vertically extending wall of said hole to be adjacent said major central portion of said tie-supporting bar at a point intermediate said upper and lower portions thereof, said second protuberance being disposed opposite said first protuberance.

* * * * *